US007279017B2

(12) United States Patent
Kresnyak et al.

(10) Patent No.: US 7,279,017 B2
(45) Date of Patent: Oct. 9, 2007

(54) METHOD FOR CONVERTING HEAVY OIL RESIDUUM TO A USEFUL FUEL

(75) Inventors: Steve Kresnyak, Calgary (CA); Edward Warchol, Calgary (CA)

(73) Assignee: Colt Engineering Corporation, Calgary, Alberta (CA)

( * ) Notice: Subject to any disclaimer, the term of this patent is extended or adjusted under 35 U.S.C. 154(b) by 434 days.

(21) Appl. No.: 10/369,511

(22) Filed: Feb. 21, 2003

(65) Prior Publication Data

US 2003/0131526 A1 Jul. 17, 2003

Related U.S. Application Data

(63) Continuation-in-part of application No. 09/842,839, filed on Apr. 27, 2001, now Pat. No. 6,530,965.

(51) Int. Cl.
*C10L 1/32* (2006.01)

(52) U.S. Cl. ..... 44/301; 516/20; 516/38; 208/22; 208/29

(58) Field of Classification Search ..... 44/301; 576/20, 38; 208/22, 29
See application file for complete search history.

(56) References Cited

U.S. PATENT DOCUMENTS

| | | | | |
|---|---|---|---|---|
| 3,396,537 | A | 8/1968 | Lissant et al. | 60/216 |
| 3,409,420 | A | 11/1968 | Booth et al. | 44/4 |
| 3,409,560 | A | 11/1968 | Faust et al. | 252/309 |
| 3,458,294 | A | 7/1969 | Nixon et al. | 44/51 |
| 3,490,237 | A | 1/1970 | Lissant | 60/217 |
| 3,527,581 | A | 9/1970 | Brownawell et al. | 44/51 |
| 3,539,406 | A | 11/1970 | Lissant | 149/109 |
| 3,540,866 | A | 11/1970 | Miller | 44/51 |
| 3,547,605 | A | 12/1970 | Cornelius, III et al. | 44/4 |
| 3,606,868 | A | 9/1971 | Voogd | 125/25 R |
| 3,615,290 | A | 10/1971 | Nixon et al. | 44/51 |
| 3,617,095 | A | 11/1971 | Lissant et al. | 302/66 |

(Continued)

FOREIGN PATENT DOCUMENTS

WO WO99/64719 A2 12/1999

(Continued)

OTHER PUBLICATIONS

*Emulsification A solution to Asphaltene Handling Problems*, Dr. Sundaram Logaraj et. al.; Presented at the: ISSA/AEMA 2nd Joint Conference, Mar. 12-13, 2000, Amelia Island, FL, USA.

(Continued)

*Primary Examiner*—Cephia D. Toomer
(74) *Attorney, Agent, or Firm*—Paul Sharpe; Ogilvy Renault LLP

(57) ABSTRACT

A method for enabling the use of heavy oil residuum by conversion to a useful product. The method, in one embodiment, involves the use of a heavy oil residuum which is substantially non flowable. The viscosity of the residuum is reduced by heat or a combination of heat and a diluent and subsequently mixed with water such that the mixing is high shear mixing. This results in the formation of an emulsion of predispersed residuum in an aqueous matrix. The emulsion is formed such that the aqueous matrix is in a size distribution suitable for use as a combustible fuel.

29 Claims, 7 Drawing Sheets

U.S. PATENT DOCUMENTS

| | | | | |
|---|---|---|---|---|
| 3,637,357 | A | 1/1972 | Nixon et al. | 44/51 |
| 3,642,608 | A | 2/1972 | Roach et al. | 208/8 |
| 3,658,302 | A | 4/1972 | Duthion et al. | 259/18 |
| 3,672,853 | A | 6/1972 | Reman et al. | 44/52 |
| 3,709,747 | A | 1/1973 | Nixon et al. | 149/22 |
| 3,732,084 | A | 5/1973 | Nixon et al. | 44/51 |
| 3,743,486 | A | 7/1973 | Franciscovich | 44/51 |
| 3,743,555 | A | 7/1973 | Seaman | 149/36 |
| 3,756,794 | A | 9/1973 | Ford | 44/51 |
| 3,764,547 | A | 10/1973 | Schlinger et al. | 252/184 |
| 3,816,329 | A | 6/1974 | Kenney et al. | 252/312 |
| 3,846,086 | A | 11/1974 | Balch et al. | 44/40 |
| 3,849,323 | A | 11/1974 | Hollinshead | 252/56 R |
| 3,853,497 | A | 12/1974 | Miller et al. | 44/62 |
| 3,876,391 | A | 4/1975 | McCoy et al. | 44/51 |
| 3,902,869 | A | 9/1975 | Friberg et al. | 44/51 |
| 3,907,134 | A | 9/1975 | Metzger | 44/51 |
| 3,908,762 | A | 9/1975 | Redford | 166/263 |
| 3,915,970 | A | 10/1975 | Limaye et al. | 260/248 |
| 4,008,924 | A | 2/1977 | Gogarty et al. | 302/66 |
| 4,011,843 | A | 3/1977 | Feuerman | 123/119 |
| 4,030,894 | A | 6/1977 | Marlin et al. | 44/51 |
| 4,061,473 | A | 12/1977 | Norris | 44/51 |
| 4,069,022 | A | 1/1978 | Metzger | 44/51 |
| 4,074,978 | A | 2/1978 | Panzer | 44/62 |
| 4,082,516 | A | 4/1978 | Metzger | 44/551 |
| 4,083,698 | A | 4/1978 | Wenzel et al. | 44/51 |
| 4,084,940 | A | 4/1978 | Lissant | 44/51 |
| 4,089,657 | A | 5/1978 | Keller | 44/51 |
| 4,101,293 | A | 7/1978 | Krause et al. | 44/51 |
| 4,115,313 | A | 9/1978 | Lyon et al. | 252/309 |
| 4,116,610 | A | 9/1978 | Berthiaume | 431/4 |
| 4,121,995 | A | 10/1978 | Hsu | 208/8 |
| 4,127,138 | A | 11/1978 | Sweeney | 137/13 |
| 4,130,400 | A | 12/1978 | Meyer | 44/51 |
| 4,130,401 | A | 12/1978 | Meyer et al. | 44/51 |
| 4,147,519 | A | 4/1979 | Sawyer, Jr. | 44/51 |
| 4,149,854 | A | 4/1979 | Kohn | 44/51 |
| 4,149,855 | A | 4/1979 | Kohn et al. | 44/51 |
| 4,153,421 | A | 5/1979 | Marlin | 44/51 |
| 4,156,434 | A | 5/1979 | Parker et al. | 137/13 |
| 4,158,551 | A | 6/1979 | Feuerman | 44/51 |
| 4,162,143 | A | 7/1979 | Yount, III | 44/51 |
| 4,163,644 | A | 8/1979 | Bowers | 44/51 |
| 4,165,969 | A | 8/1979 | Hughes et al. | 44/51 |
| 4,171,957 | A | 10/1979 | Moriyama et al. | 44/51 |
| 4,173,455 | A | 11/1979 | Fodor et al. | 44/51 |
| 4,177,039 | A | 12/1979 | Sakuma et al. | 44/51 |
| 4,182,613 | A | 1/1980 | Stover et al. | 44/51 |
| 4,182,614 | A | 1/1980 | Moriyama et al. | 44/51 |
| 4,187,078 | A | 2/1980 | Shimizu et al. | 44/51 |
| 4,195,975 | A | 4/1980 | Hamuro et al. | 44/51 |
| 4,199,326 | A | 4/1980 | Fung | 44/51 |
| 4,201,552 | A | 5/1980 | Rowell et al. | 44/51 |
| 4,203,728 | A | 5/1980 | Norton | 44/51 |
| 4,203,729 | A | 5/1980 | Ishizaki et al. | 44/51 |
| 4,208,251 | A | 6/1980 | Rasmussen | 201/14 |
| 4,218,221 | A | 8/1980 | Cottell | 44/51 |
| 4,244,700 | A | 1/1981 | Chukhanov et al. | 44/1 R |
| 4,244,702 | A | 1/1981 | Alliger | 44/51 |
| 4,246,000 | A | 1/1981 | Kobayashi et al. | 44/51 |
| 4,251,229 | A | 2/1981 | Naka et al. | 44/51 |
| 4,251,230 | A | 2/1981 | Sawyer, Jr. | 44/51 |
| 4,252,540 | A | 2/1981 | Yamamura et al. | 44/51 |
| 4,266,943 | A | 5/1981 | Lo | 44/51 |
| 4,272,253 | A | 6/1981 | Schulz et al. | 44/51 |
| 4,276,054 | A | 6/1981 | Schmolka et al. | 44/51 |
| 4,288,232 | A | 9/1981 | Schmolka et al. | 44/51 |
| 4,291,720 | A | 9/1981 | Folland | 137/209 |
| 4,293,312 | A | 10/1981 | Fox | 44/1 R |
| 4,293,313 | A | 10/1981 | Fox | 44/1 R |
| 4,295,859 | A | 10/1981 | Boehmke | 44/51 |
| 4,297,107 | A | 10/1981 | Boehmke | 44/51 |
| 4,304,573 | A | 12/1981 | Burgess et al. | 44/51 |
| 4,305,729 | A | 12/1981 | Stearns | 44/51 |
| 4,306,881 | A | 12/1981 | Stearns | 44/51 |
| 4,306,882 | A | 12/1981 | Stearns | 44/51 |
| 4,306,883 | A | 12/1981 | Eckman | 44/51 |
| 4,309,191 | A | 1/1982 | Hiroya et al. | 44/51 |
| 4,309,269 | A | 1/1982 | Denker et al. | 208/8 LE |
| 4,315,755 | A | 2/1982 | Hellsten et al. | 44/51 |
| 4,332,593 | A | 6/1982 | Burgess et al. | 44/51 |
| 4,339,246 | A | 7/1982 | Yamamura et al. | 44/51 |
| 4,347,061 | A | 8/1982 | Madsen et al. | 44/51 |
| 4,355,969 | A | 10/1982 | Nelson et al. | 431/4 |
| 4,358,292 | A | 11/1982 | Battista | 44/51 |
| 4,358,293 | A | 11/1982 | Mark | 44/51 |
| 4,363,637 | A | 12/1982 | Knitter et al. | 44/51 |
| 4,364,741 | A | 12/1982 | Villa | 44/51 |
| 4,364,742 | A | 12/1982 | Knitter et al. | 44/51 |
| 4,374,647 | A | 2/1983 | Bezman | 44/56 |
| 4,377,392 | A | 3/1983 | Massey et al. | 44/51 |
| 4,378,230 | A | 3/1983 | Rhee | 44/51 |
| 4,382,802 | A | 5/1983 | Beinke et al. | 44/51 |
| 4,389,219 | A | 6/1983 | Naka et al. | 44/51 |
| 4,392,865 | A | 7/1983 | Grosse et al. | 44/51 |
| 4,394,131 | A | 7/1983 | Marro, Jr. et al. | 44/51 |
| 4,395,266 | A | 7/1983 | Han | 44/51 |
| 4,396,397 | A | 8/1983 | Kugel et al. | 44/51 |
| 4,396,400 | A | 8/1983 | Grangette et al. | 44/75 |
| 4,397,653 | A | 8/1983 | Longanbach | 44/51 |
| 4,398,918 | A | 8/1983 | Newman | 44/51 |
| 4,400,177 | A | 8/1983 | Cottell | 44/51 |
| 4,401,437 | A | 8/1983 | Poetschke et al. | 44/2 |
| 4,403,996 | A | 9/1983 | Matsuura et al. | 44/1 G |
| 4,406,664 | A | 9/1983 | Burgess et al. | 44/51 |
| 4,412,844 | A | 11/1983 | Collins et al. | 44/51 |
| 4,422,855 | A | 12/1983 | Sawyer, Jr. | 44/51 |
| 4,425,135 | A | 1/1984 | Jenkins | 44/51 |
| 4,436,527 | A | 3/1984 | Yamamura et al. | 44/51 |
| 4,441,887 | A | 4/1984 | Funk | 44/51 |
| 4,441,889 | A | 4/1984 | Mark | 44/51 |
| 4,441,890 | A | 4/1984 | Feldman | 44/51 |
| 4,446,012 | A * | 5/1984 | Murthy et al. | 208/130 |
| 4,447,348 | A | 5/1984 | Forsberg | 252/75 |
| 4,453,947 | A | 6/1984 | Shah et al. | 44/51 |
| 4,465,494 | A | 8/1984 | Bourrel et al. | 44/51 |
| 4,469,486 | A | 9/1984 | Shah et al. | 44/51 |
| 4,474,578 | A | 10/1984 | Cornils et al. | 44/51 |
| 4,475,924 | A | 10/1984 | Meyer | 44/51 |
| 4,477,259 | A | 10/1984 | Funk | 44/51 |
| 4,477,260 | A | 10/1984 | Funk | 44/51 |
| 4,478,602 | A | 10/1984 | Kelley et al. | 44/51 |
| 4,478,603 | A | 10/1984 | Mark | 44/51 |
| 4,479,806 | A | 10/1984 | Funk | 44/51 |
| 4,484,929 | A | 11/1984 | Rutter et al. | 44/51 |
| 4,492,590 | A | 1/1985 | Schick et al. | 44/51 |
| 4,494,960 | A | 1/1985 | Dolkemeyer et al. | 44/51 |
| 4,501,205 | A | 2/1985 | Funk | 110/347 |
| 4,511,364 | A | 4/1985 | Mitsumori | 44/51 |
| 4,511,365 | A | 4/1985 | Mark | 44/51 |
| 4,512,774 | A | 4/1985 | Myers et al. | 44/51 |
| 4,526,585 | A | 7/1985 | Burgess et al. | 44/51 |
| 4,529,408 | A | 7/1985 | Yan | 44/51 |
| 4,530,701 | A | 7/1985 | Koskan et al. | 44/51 |
| 4,547,199 | A | 10/1985 | Boehmke et al. | 44/51 |
| 4,553,978 | A | 11/1985 | Yvan | 44/1 E |
| 4,555,248 | A | 11/1985 | Bronfenbrenner et al. | 44/78 |
| 4,595,396 | A | 6/1986 | Erdman | 44/63 |
| 4,601,729 | A | 7/1986 | Capes et al. | 44/51 |
| 4,604,188 | A | 8/1986 | Yan et al. | 208/106 |
| 4,605,420 | A | 8/1986 | McGarry et al. | 44/1 R |
| 4,608,057 | A | 8/1986 | Davis et al. | 44/51 |
| 4,610,695 | A | 9/1986 | Crespin et al. | 44/51 |

4,618,348 A 10/1986 Hayes et al. ..... 44/51
4,622,046 A 11/1986 D'Intino et al. ..... 44/51
4,623,359 A 11/1986 Yaghmaie et al. ..... 44/51
4,623,447 A 11/1986 Clampitt et al. ..... 208/187
4,629,472 A 12/1986 Haney, III et al. ..... 44/51
4,637,822 A 1/1987 Niu et al. ..... 44/51
4,650,496 A 3/1987 Funk ..... 44/51
4,666,457 A 5/1987 Hayes et al. ..... 44/51
4,670,019 A 6/1987 Paspek ..... 44/51
4,671,800 A 6/1987 Meyer et al. ..... 44/51
4,671,801 A 6/1987 Burgess et al. ..... 44/51
4,684,372 A 8/1987 Hayes et al. ..... 44/51
4,685,936 A 8/1987 Meyer et al. ..... 44/51
4,687,491 A 8/1987 Latty ..... 44/51
4,692,270 A 9/1987 Sato et al. ..... 252/353
4,696,638 A 9/1987 DenHerder ..... 431/4
4,696,677 A 9/1987 Colegrove et al. ..... 44/51
4,704,134 A 11/1987 Meyer et al. ..... 44/51
4,705,533 A 11/1987 Simmons ..... 44/51
4,708,720 A 11/1987 Grangette et al. ..... 44/51
4,711,643 A 12/1987 Kemp et al. ..... 44/51
4,713,086 A 12/1987 Smit et al. ..... 44/51
4,725,287 A 2/1988 Gregoli et al. ..... 44/51
4,732,576 A 3/1988 Friedrich et al. ..... 44/51
4,737,158 A 4/1988 Antonini et al. ..... 44/51
4,744,797 A 5/1988 Shimada et al. ..... 44/51
4,755,325 A 7/1988 Osgerby ..... 252/314
4,756,721 A 7/1988 Correra et al. ..... 44/7.1
4,757,833 A 7/1988 Danley ..... 137/13
4,759,267 A 7/1988 Wang et al. ..... 44/51
4,770,670 A 9/1988 Hazbun et al. ..... 44/51
4,780,109 A 10/1988 Malone et al. ..... 44/51
4,787,915 A 11/1988 Meyer et al. ..... 44/51
4,793,826 A 12/1988 Hayes et al. ..... 44/51
4,795,478 A 1/1989 Layrisse R. et al. ..... 44/51
4,801,304 A 1/1989 Polanco et al. ..... 44/51
4,804,495 A 2/1989 Bouchez et al. ..... 252/312
4,821,757 A 4/1989 Hayes et al. ..... 137/13
4,824,439 A 4/1989 Polanco et al. ..... 44/51
4,832,701 A 5/1989 Polanco et al. ..... 44/51
4,832,747 A 5/1989 Marchal ..... 106/277
4,832,831 A 5/1989 Meyer et al. ..... 208/431
4,842,616 A 6/1989 Verhille ..... 44/51
4,877,414 A 10/1989 Mekonen ..... 44/51
4,886,519 A 12/1989 Hayes et al. ..... 44/51
4,892,560 A 1/1990 Sial ..... 44/50
4,907,368 A 3/1990 Mullay et al. ..... 44/51
4,908,154 A 3/1990 Cook et al. ..... 252/314
4,911,736 A 3/1990 Huang et al. ..... 44/51
4,923,483 A 5/1990 Layrisse R. et al. ..... 44/51
4,933,086 A 6/1990 McMahon et al. ..... 210/603
4,943,390 A 7/1990 Hayes et al. ..... 252/355
4,949,743 A 8/1990 Broom ..... 137/13
4,950,307 A 8/1990 Najjar et al. ..... 44/51
4,976,745 A 12/1990 Rodriguez et al. ..... 44/301
4,978,365 A 12/1990 Gregoli et al. ..... 44/301
4,978,367 A 12/1990 Green et al. ..... 44/281
4,983,319 A 1/1991 Gregoli et al. ..... 252/314
4,994,090 A 2/1991 Rodriguez et al. ..... 44/301
5,000,757 A 3/1991 Puttock et al. ..... 44/301
5,000,872 A 3/1991 Olah ..... 252/314
5,008,035 A 4/1991 Broom ..... 252/312
5,013,462 A 5/1991 Danley ..... 252/8.554
5,024,676 A 6/1991 Moriyama et al. ..... 44/301
5,096,461 A 3/1992 Frankiewicz et al. ..... 44/281
5,104,418 A 4/1992 Genova et al. ..... 44/302
5,110,443 A 5/1992 Gregoli et al. ..... 208/46
5,123,931 A 6/1992 Good et al. ..... 44/281
5,133,898 A 7/1992 Fock et al. ..... 252/356
5,196,129 A 3/1993 Luisi ..... 252/49.5
5,202,056 A 4/1993 Sung et al. ..... 252/351
5,207,891 A 5/1993 Sung et al. ..... 208/44
5,217,076 A 6/1993 Masek ..... 166/303
5,234,475 A 8/1993 Malhotra et al. ..... 44/282
5,244,475 A 9/1993 Lownds et al. ..... 44/271
5,263,848 A 11/1993 Gregoli et al. ..... 431/4
5,283,001 A 2/1994 Gregoli et al. ..... 252/314
5,284,492 A 2/1994 Dubin ..... 44/301
5,288,295 A 2/1994 Hypes et al. ..... 44/301
5,296,005 A 3/1994 Wolfe et al. ..... 44/551
5,338,485 A 8/1994 Fock et al. ..... 252/309
5,344,306 A 9/1994 Brown et al. ..... 431/4
5,360,458 A 11/1994 Forsberg et al. ..... 44/301
5,372,613 A 12/1994 Mekonen ..... 44/301
5,380,343 A 1/1995 Hunter ..... 44/302
5,401,341 A 3/1995 Forsberg et al. ..... 149/46
5,411,558 A 5/1995 Taniguchi et al. ..... 44/301
5,419,852 A 5/1995 Rivas et al. ..... 252/312
5,439,489 A 8/1995 Scalliet et al. ..... 44/281
5,445,656 A 8/1995 Marelli ..... 44/310
5,454,666 A 10/1995 Chaback et al. ..... 405/52
5,478,365 A 12/1995 Nikanjam et al. ..... 44/280
5,478,366 A 12/1995 Teo et al. ..... 44/301
5,480,583 A 1/1996 Rivas et al. ..... 252/311.5
5,499,587 A 3/1996 Rodriquez et al. ..... 110/342
5,503,643 A 4/1996 Schriver et al. ..... 44/282
5,503,772 A 4/1996 Rivas et al. ..... 252/314
5,505,876 A 4/1996 Rivas et al. ..... 252/311
5,505,877 A 4/1996 Krivohlavek ..... 252/314
5,511,969 A 4/1996 Lopes et al. ..... 431/4
5,513,584 A 5/1996 Rodriguez et al. ..... 110/342
5,535,708 A 7/1996 Valentine ..... 123/25
5,556,574 A 9/1996 Rivas et al. ..... 252/311.5
5,584,894 A 12/1996 Peter-Hoblyn et al. ..... 44/301
5,603,864 A 2/1997 Silva et al. ..... 252/311.5
5,611,824 A 3/1997 Stephens ..... 44/282
5,622,920 A 4/1997 Rivas et al. ..... 507/232
5,641,433 A 6/1997 Chirinos et al. ..... 252/312
5,669,938 A 9/1997 Schwab ..... 44/301
5,679,236 A 10/1997 Poschl ..... 205/351
5,685,153 A 11/1997 Dickinson et al. ..... 60/648
5,693,106 A 12/1997 Peter-Hoblyn et al. ..... 44/301
5,725,609 A 3/1998 Rivas et al. ..... 44/301
5,743,922 A 4/1998 Peter-Hoblyn et al. ..... 44/301
5,746,783 A 5/1998 Compere et al. ..... 44/301
5,779,990 A 7/1998 Iwata ..... 422/186.04
5,788,721 A 8/1998 Scalliet et al. ..... 44/281
5,792,223 A 8/1998 Rivas et al. ..... 44/302
5,800,576 A 9/1998 Johnson et al. ..... 44/301
5,807,476 A 9/1998 Collins et al. ..... 208/236
5,820,640 A 10/1998 Ikura et al. ..... 44/301
5,834,539 A 11/1998 Krivohlavek ..... 524/60
5,851,245 A 12/1998 Moriyama et al. ..... 44/301
5,856,680 A 1/1999 Shirodkar ..... 252/314
5,873,916 A 2/1999 Cemenska et al. ..... 44/301
5,879,419 A 3/1999 Moriyama et al. ..... 44/301
5,885,310 A 3/1999 Minamidate ..... 44/301
5,900,112 A 5/1999 Spontak et al. ..... 162/30.11
5,902,227 A 5/1999 Rivas ..... 516/54
5,902,359 A 5/1999 Grosse et al. ..... 44/281
5,925,233 A 7/1999 Miller et al. ..... 208/48 AA
5,944,984 A 8/1999 Benguigui et al. ..... 208/309
5,964,906 A 10/1999 Layrisse et al. ..... 44/302
5,976,200 A 11/1999 Rivas et al. ..... 44/301
5,980,733 A 11/1999 Collins et al. ..... 208/236
5,992,354 A 11/1999 Ahern et al. ..... 123/25
5,993,495 A 11/1999 Sanchez et al. ..... 44/301
5,993,496 A 11/1999 Sung et al. ..... 44/301
5,997,590 A 12/1999 Johnson et al. ..... 44/301
5,997,591 A 12/1999 Matsuda et al. ..... 44/301
6,001,886 A 12/1999 Shirodkar ..... 516/51
6,010,544 A 1/2000 Haldeman et al. ..... 44/301
6,017,368 A 1/2000 Steinmann ..... 44/302
6,030,424 A 2/2000 Matsumoto ..... 44/301
6,066,186 A 5/2000 Matsumoto ..... 44/301
6,066,679 A 5/2000 Leviness et al. ..... 518/709

| | | | | |
|---|---|---|---|---|
| 6,068,670 | A | 5/2000 | Haupais et al. | 44/301 |
| 6,069,178 | A | 5/2000 | Layrisse et al. | 516/50 |
| 6,077,322 | A | 6/2000 | Shiao | 44/301 |
| 6,080,211 | A | 6/2000 | Mathur | 44/301 |
| 6,113,659 | A | 9/2000 | Logaraj et al. | 44/280 |
| RE36,983 | E | 12/2000 | Hayes et al. | 44/301 |
| 6,187,063 | B1 | 2/2001 | Gunnerman | 44/301 |
| 6,190,427 | B1 | 2/2001 | Ahmed | 44/302 |
| 6,194,472 | B1 | 2/2001 | Logaraj et al. | 516/43 |
| 6,211,251 | B1 | 4/2001 | Satterfield | 516/10 |
| 6,235,067 | B1 | 5/2001 | Ahern et al. | 44/301 |
| 6,248,140 | B1 | 6/2001 | Genssler et al. | 44/281 |
| 6,280,485 | B1 | 8/2001 | Daly et al. | 44/301 |
| 6,280,486 | B1 | 8/2001 | Dessauer et al. | 44/302 |
| 6,281,253 | B1 | 8/2001 | Satterfield | 516/10 |
| 6,293,975 | B1 | 9/2001 | Scalliet et al. | 44/281 |
| 6,294,587 | B1 | 9/2001 | Wittenbrink et al. | 516/76 |
| 6,296,676 | B1 | 10/2001 | Nohara | 44/301 |
| 6,306,184 | B2 | 10/2001 | Ahmed | 44/302 |
| 6,325,833 | B1 | 12/2001 | Berlowitz | 44/301 |
| 6,331,575 | B1 | 12/2001 | Mauldin | 518/715 |
| 6,364,917 | B1 | 4/2002 | Matsumura et al. | 44/301 |
| 6,368,366 | B1 | 4/2002 | Langer et al. | 44/301 |
| 6,368,367 | B1 | 4/2002 | Langer et al. | 44/301 |
| 6,368,368 | B1 | 4/2002 | Reeves | 44/301 |
| 6,371,998 | B1 | 4/2002 | Mathur | 44/301 |
| 6,375,689 | B2 | 4/2002 | Marelli | 44/301 |
| 6,379,404 | B1 | 4/2002 | Ru | 44/301 |
| 6,383,237 | B1 | 5/2002 | Langer et al. | 44/301 |
| 6,384,091 | B2 | 5/2002 | Layrisse et al. | 516/50 |
| 6,386,750 | B2 | 5/2002 | Marelli | 366/152.1 |
| 6,413,361 | B1 | 7/2002 | Hino et al. | 159/44 |
| 6,419,714 | B2 | 7/2002 | Thompson et al. | 44/31 |
| 6,440,000 | B1 | 9/2002 | Firey | 44/639 |
| 6,447,556 | B1 | 9/2002 | Cemenska et al. | 44/301 |
| 6,458,855 | B1 | 10/2002 | Wittenbrink et al. | 516/76 |
| 6,471,732 | B1 | 10/2002 | Shimada | 44/281 |
| 6,503,286 | B1 | 1/2003 | Lacaze et al. | 44/301 |
| 6,511,937 | B1 | 1/2003 | Bearden, Jr. et al. | 502/180 |
| 6,530,964 | B2 | 3/2003 | Langer et al. | 44/301 |
| 6,530,965 | B2 * | 3/2003 | Warchol | 44/301 |
| 6,530,966 | B1 | 3/2003 | Kriech et al. | 44/542 |
| 6,569,909 | B1 | 5/2003 | O'Reilly et al. | 518/700 |
| 6,589,301 | B1 | 7/2003 | Magnin et al. | 44/301 |
| 6,606,856 | B1 | 8/2003 | Brown et al. | 60/299 |
| 6,607,566 | B1 | 8/2003 | Coleman et al. | 44/301 |
| 6,623,535 | B1 | 9/2003 | Kief | 44/301 |
| 6,638,323 | B2 | 10/2003 | Tsai et al. | 44/301 |
| 6,648,929 | B1 | 11/2003 | Daly et al. | 44/301 |
| 6,652,607 | B2 | 11/2003 | Langer et al. | 44/301 |
| 6,656,236 | B1 | 12/2003 | Coleman et al. | 44/301 |
| 6,663,680 | B1 | 12/2003 | Dodd et al. | 44/301 |
| 6,677,387 | B2 | 1/2004 | Gurfinkel Castillo et al. | 516/53 |
| 6,736,215 | B2 | 5/2004 | Maher et al. | 166/402 |
| 6,740,133 | B2 | 5/2004 | Hundley, Jr. | 44/301 |
| 6,745,831 | B2 | 6/2004 | de Rouffignac et al. | 166/245 |
| 6,805,195 | B2 | 10/2004 | Vinegar et al. | 166/251.1 |
| 6,808,693 | B2 | 10/2004 | Arnaud et al. | 423/212 |
| 6,860,911 | B2 | 3/2005 | Hundley | 44/620 |
| 6,883,607 | B2 | 4/2005 | Nenniger et al. | 166/272.4 |
| 2002/0005374 | A1 | 1/2002 | Bearden, Jr. et al. | 208/86 |
| 2002/0157304 | A1 | 10/2002 | Warchol | 44/301 |
| 2004/0205995 | A1 | 10/2004 | Zucchelli et al. | 44/500 |

FOREIGN PATENT DOCUMENTS

| | | |
|---|---|---|
| WO | WO 01/60952 | 8/2001 |

OTHER PUBLICATIONS

Mitsubishi Heavy Industries, Ltd.; Masaki Iijima and Takashi Kamijo "Flue Gas CO2 Recovery and Compression Cost Study for CO2 Enhanced Oil Recovery"; Oct. 2002.

ALSTOM; "Oxygen-fired Circulating Fluidized Bed (CFB) Technology Development"; Aug. 9-11, 2004; Calgary, Alberta, Canada.

SPE (Society of Petroleum Engineers); S. Doieschall, A. Szittar and G. Udvardi; "Review of the 30 Years' Experience of the CO2 Imported Oil Recovery Projects in Hungary"; SPE22362; pp. 305-317; Mar. 24-27, 1992; Beijing, China.

* cited by examiner

METHOD FOR CONVERTING HEAVY OIL RESIDUUM TO A USEFUL FUEL

CROSS-REFERENCE TO RELATED APPLICATIONS

This application is a continuation in part of U.S. patent application Ser. No. 09/842,839, filed Apr. 27, 2001, now U.S. Pat. No. 6,530,965.

FIELD OF THE INVENTION

The present invention relates to a method for enabling the use of heavy oil residuum to a useful product and more particularly, the present invention relates to a method for converting such residuum to a fuel which can be used for power generation and steam production for heavy oil recovery, and as a direct process heating source.

BACKGROUND OF THE INVENTION

In view of escalating fuel prices and particularly natural gas prices, there has been a resurgence in the need to consider less costly fuel options.

One of the limitations in the fuel generation art is that the art has not thoroughly considered the possibility of using materials which are generally not considered as fuels, but have the possibility of conversion to useful fuel. One such material that is useful is residuum and in particular, heavy oil residuum. Such materials present numerous difficulties in that the viscosity is quite high to the point that the material almost comprises a solid and thus handling and conversion to a form suitable for use as a combustible fuel have presented difficulties. It is known in the chemical engineering field that droplet size range is important to produce a fuel which will burn in a host of boiler types and not present problems in terms of boiler selection, sufficient carbon burnout or violation of existing flue gas opacity standards.

It has been proposed previously to convert other materials to a fuel, however, such proposals have not proved viable, since droplet size could not be produced in a size distribution sufficient to be efficiently burned in a wide variety of boilers or other combustion devices.

In U.S. Pat. No. 5,551,956, issued to Moriyama et al., Sep. 3, 1996, there is disclosed a super heavy oil emulsion fuel and method for generating deteriorated oil and water super heavy oil emulsion fuel. The fuel is indicated to have a relatively low viscosity and adequate long-term stability and comprises in an emulsified state 100 parts by weight of a super heavy oil, 25 to 80 parts by weight water and 0.02 to 5 parts by weight of the non-ionic surfactant. This reference teaches a useful fuel, however, there is no recognition of formulating an emulsion which creates a particle size sufficient for use as an energy source in a boiler for use in power generation and steam recovery for heavy oil recovery.

Ichinose et al., in U.S. Pat. No. 6,036,473, issued Mar. 14, 2000, teaches a heavy oil emulsified fuel combustion apparatus. This reference is primarily focused on the apparatus and does not go into any real detail with respect to a fuel or conversion process for converting residuum to a useful combustible fuel.

U.S. Pat. No. 6,001,886, issued to Shirodkar, Dec. 14, 1999, teaches an asphalt emulsion formation process. The process involves preheating the asphalt residue for combination with emulsifier with subsequent mixture to a homomixer. The temperature is relatively low at 38° C. in order to prevent interference in the emulsification. This is reflected in the Patentee's comments concerning the importance of not exceeding 100° C. to prevent dehydration of the emulsion.

Bando, in U.S. Pat. No. 6,183,629, issued Feb. 6, 2001, sets forth an emulsion formulating apparatus for formulating liquid/solid emulsions. The emulsions formed with the apparatus have a wide particle distribution as opposed to a specific distribution required for combustion. By the Bando device, it would appear that the arrangement is specifically designed for fluid (liquid/solid) emulsion transport instead of liquid/liquid emulsion combustion.

It would be desirable if there were a method to formulate a combustible fuel in a desirable size range for the emulsified particles to be used in any type of boiler for use as an energy source. The present invention speaks to the issues in the industry and presents a particle having a droplet size necessary to achieve more efficient burning.

SUMMARY OF THE INVENTION

One object of the present invention is to provide a method for converting heavy oil liquid residuum to a combustible fuel, comprising the steps of:

- providing a source of heavy oil liquid residuum having a viscosity such that the residuum is substantially non flowable;
- reducing the viscosity of the residuum by preheating in a temperature range sufficient to facilitate flow without thermally degrading the residuum;
- providing a mixing means;
- providing a source of water;
- mixing the water and reduced viscosity residuum in the mixing means to form in the mixing means, an emulsion of predispersed residuum in an aqueous matrix in a size distribution suitable for use as a combustible fuel; and
- maintaining the emulsion under pressure to prevent dehydration of the emulsion.

Advantageously, the present invention ensures a relatively narrow size distribution where the emulsified particles fall within the size distribution of 0.5 microns to 50 microns. In this size distribution, the choice for boiler selection is fairly broad whereas particles in a size distribution of greater than 50 microns present complications in that boiler selection is restricted generally to only fluid bed combustion technology. It also becomes difficult to obtain sufficient carbon burnout with a large size droplet and presents complications of flue gas opacity.

It has been found that by providing a process for generating a droplet within the size distribution indicated above, there is a significant increase in the technology options employable to the user, including the use of fluid bed boilers, conventional radiant boilers and conventional once through steam generators, commonly employed in the heavy oil recovery operations.

A further object of one embodiment of the invention is to provide a method for converting heavy oil residuum to a combustible fuel, comprising the steps of:

- providing a source of heavy oil liquid residuum having a viscosity such that the residuum is substantially non flowable;
- progressively reducing the viscosity of the residuum in at least two stages to facilitate flow of the residuum, the stages comprising:
- a first stage including treating the residuum with a liquid diluent to form a reduced viscosity residuum;

a second stage including preheating the reduced viscosity residuum;

providing a mixing means;

providing a source of water;

mixing the water and reduced viscosity residuum in the mixing means to form in the mixing means, an emulsion of predispersed residuum in an aqueous matrix in a particle size distribution of between 0.5 microns and 50 microns suitable for use as a combustible fuel; and maintaining the emulsion under pressure to prevent dehydration of the emulsion.

It has been found that the control of the viscosity of the residuum is important so that the material can be mixed in a mixer capable of formulating a micro-sized emulsion. A suitable mixer that has been employed to effect the present invention can consist of a variety of suitable mixers manufactured by the Kenics Company among others. The company produces a helical mixing arrangement which is useful for particularly efficient mixing. Other suitable devices, such as that manufacture by Chemicolloid Laboratories Inc., capable of formulating the emulsion include collation mills which may be ganged in series or parallel, and other more generic devices such as backward centrifugal and gear pumps positioned in series inter alia. The type of mixer will be apparent to one skilled in the art. The choice of the mixer will be selected to result in entrainment of the heavy oil residuum within a liquid (aqueous) matrix such that a particle distribution is formed in the range of 0.5 microns to 50 microns.

According to a further object of one embodiment of the present invention there is provided a process for converting heavy oil residuum to a combustible fuel, comprising the steps of:

providing a source of heavy oil;

pretreating the oil to remove at least a portion of entrained water;

treating the oil to form fractions, at least one of which is heavy oil residuum;

reducing the viscosity of the residuum by preheating in a temperature range sufficient to facilitate flow without thermally degrading the residuum;

providing a mixing means;

providing a source of water;

mixing the water and reduced viscosity residuum in the mixing means;

forming, in the mixing means, an emulsion of predispersed residuum in an aqueous matrix in a size distribution suitable for use as a combustible fuel; and maintaining the emulsion under pressure to prevent dehydration of the emulsion.

As a particular convenience, the fuel is kept in an emulsified form by maintaining the pressure of the emulsion. This allows direct use burn of the fuel in a burner desirable by end users. Since no further processing is required; the fuel may be passed on directly to the burner fuel supply and subsequently into the burner.

A further object of one embodiment of the present invention is to provide a method for converting heavy oil residuum to a combustible fuel, comprising the steps of:

providing a source of heavy oil;

pre-treating the oil to remove at least a portion of entrained water;

treating the oil to form fractions, at least one of which is heavy oil residuum;

progressively reducing the viscosity of the residuum in at least two stages to facilitate flow of the residuum, the stages comprising:

a first stage including treating the residuum with a liquid diluent to form a reduced viscosity residuum; and a second stage including preheating the reduced viscosity residuum in a temperature range of between 35° C. and 350° C.;

providing a mixing means;

providing a source of water;

mixing the water and reduced viscosity residuum in the mixing means to form in the mixing means, an emulsion of predispersed residuum in an aqueous matrix in a size distribution suitable for use as a combustible fuel; and maintaining the emulsion under pressure to prevent dehydration of the emulsion.

Considering the fact that the emulsions are somewhat fragile, pressurization without further processing/handling is beneficial. In the fuel of this process, pumping is not required. The fuel can be directly transported to the burner.

A still further object of one embodiment of the present invention is to provide a pressurized fuel for direct use burn, comprising an emulsion of predispersed residuum in an aqueous matrix in a size distribution suitable for use as a combustible fuel under pressure sufficient to prevent dehydration of the emulsion and in a size distribution of between 0.5 and 50 μm.

Having thus described the invention, reference will now be made to the accompanying drawing illustrating a preferred embodiment.

BRIEF DESCRIPTION OF THE DRAWINGS

Similar numerals employed in the specification denote similar elements.

DETAILED DESCRIPTION OF THE PREFERRED EMBODIMENT

Figure 1:
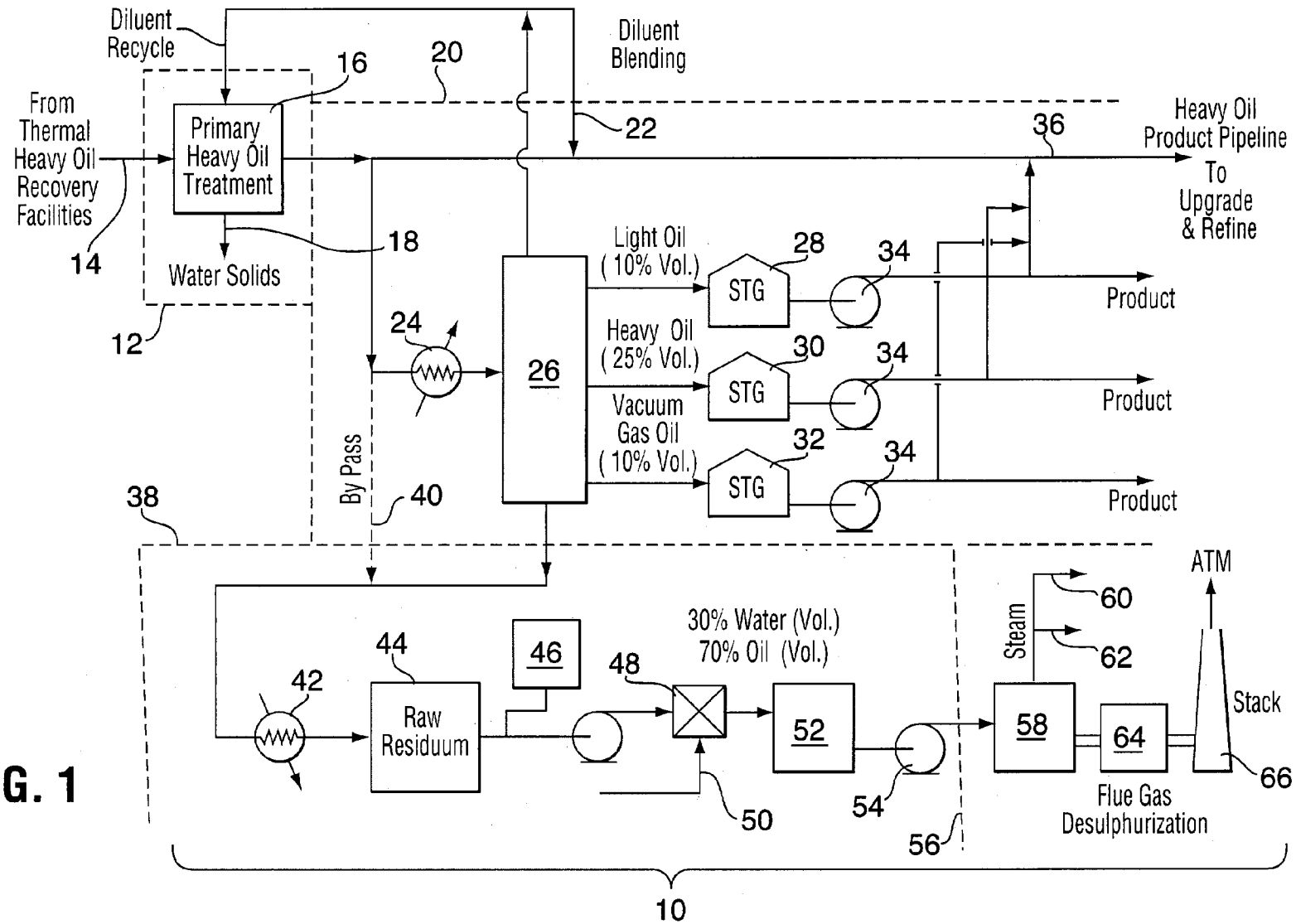
FIG. 1 is a schematic illustration of a process for converting heavy oil residuum into a fuel according to one embodiment of the invention.

Referring now to FIG. 1, shown is one embodiment of the present invention.

In FIG. 1, reference numeral 10 globally denotes the overall process. In the area bounded by the dash lines and denoted numeral 12, there is schematically illustrated a commercially practiced heavy oil separation facility which primarily results in the removal of water and solid contaminants, from the oil recovered. A source of heavy oil 14 undergoes dewatering in a known process denoted by numeral 16 with the water and solids being removed from the heavy oil, generally denoted by numeral 18. Once this has been done, the next step which is known in the art is shown in the area bounded by the dash line indicated by numeral 20. This represents a common oil fractionating process which resulted in distillation or solvent extraction of the various fractions of oil by temperature or solubility sensitivity. In these processes, a suitable diluent 22 can be introduced into the circuit to reduce the viscosity of the oil for transport and handling. The material is then heated by a heater 24 and introduced into a fractionating unit 26 where the fractions are separated based on their characteristic distillation temperatures or solubilities. Diluent is recovered and recycled to the heavy oil treatment stage denoted by numeral 12. The light oils are stored in storage vessel 28, while the heavy oils in vessel 30 and the vacuum gas oil mixture are stored in vessel 32. The light oil is in a concentration of about 10% by volume, with the heavy oil approximating 25% by oil and the vacuum gas oil mixture approximately 10% by volume. The material is then pumped by pumps 34 and left as a product or introduced to a pipeline 36 for further processing (upgrading and refining). The fractionating unit is depicted as a single unit operation, however, generally such arrangements can include multiple processing steps, atmospheric and vacuum distillation units, and solvent deasphalting units (not shown).

Turning to the area bound by chain line and indicated by numeral 38, shown is a schematic representation of the process in accordance with one embodiment of the present invention. The material from the heavy oil water recovery may be subjected to the heavy oil treatment as indicated herein previously and subsequently transported to the process denoted by numeral 38 by way of a bypass line 40 which introduces pre-treated heavy oil directly into the circuit for emulsification. The material may be cooled by a medium 42 to a temperature for storage and maintain suitable handling viscosity or fed directly to the emulsion preparation unit denoted by numeral 48. The raw residuum, denoted by numeral 44, at this point is essentially a non-flowable mass if allowed to cool to ambient conditions. Suitable surfactant stored in vessel 46, is introduced to the material prior to being pumped into an emulsification preparation unit, globally denoted by numeral 48. In the emulsification unit, water or steam is added via line 50. In the emulsification unit, intimate high shear mixing is performed which may be done by the mixers described herein previously. The desirable result from the mixing is to provide a particle distribution in a flat size distribution range of 0.5 microns to 50 microns. It is desirable also to have a water content in each particle of between 25% by weight and 40% by weight. The quantity of water and surfactant to the raw residuum will depend upon the final product considerations such as stability of the emulsion over long periods of time or short periods of time as well as other factors related to the burning of the material. It has also been found that in the process according to the present invention, the residuum need not be in a liquid phase; desirable results have been obtained where the immiscible material has been in a solid or liquid phase.

Product analysis of the final emulsion has demonstrated that the material is capable of producing 4,000 to 10,000 Btu/lb as compared to the raw residuum having between 12,000 and 14,000 Btu/lb or greater; (15,000 to 20,000 Btu/lb,) depending on the degree of cut in the fractionation unit and quality of feedstock. Accordingly, approximately 70% retention of energy is achieved per unit of aqueous fuel for a material that was previously not considered viable for use as a fuel.

One of the more attractive advantages of the process is the fact that the process is reversible; the emulsion can be de-emulsified readily to convert the material back to its original form. This has positive ramifications for further use or different uses entirely.

In terms of suitable surfactants and other chemicals which may be added to the raw residuum, the following are representative of useful examples of such compounds non-ionic surfactants, anionic surfactants, cationic surfactants inter alia.

Once the product has been emulsified, the final product contains as indicated above, generally 70% by oil weight and 30% by water weight. This material may be then stored in a vessel 52 or pumped for further processing by pump 54 to the processing stage broadly denoted by numeral 56 shown in dash line. In this process the emulsion may be burned in a combustion device 58 such as a boiler/steam generator or a cogeneration device with liberated steam going to further use such as a power generation or process heating, broadly denoted by numeral 60 or storage in a reservoir 62.

Figure 2:
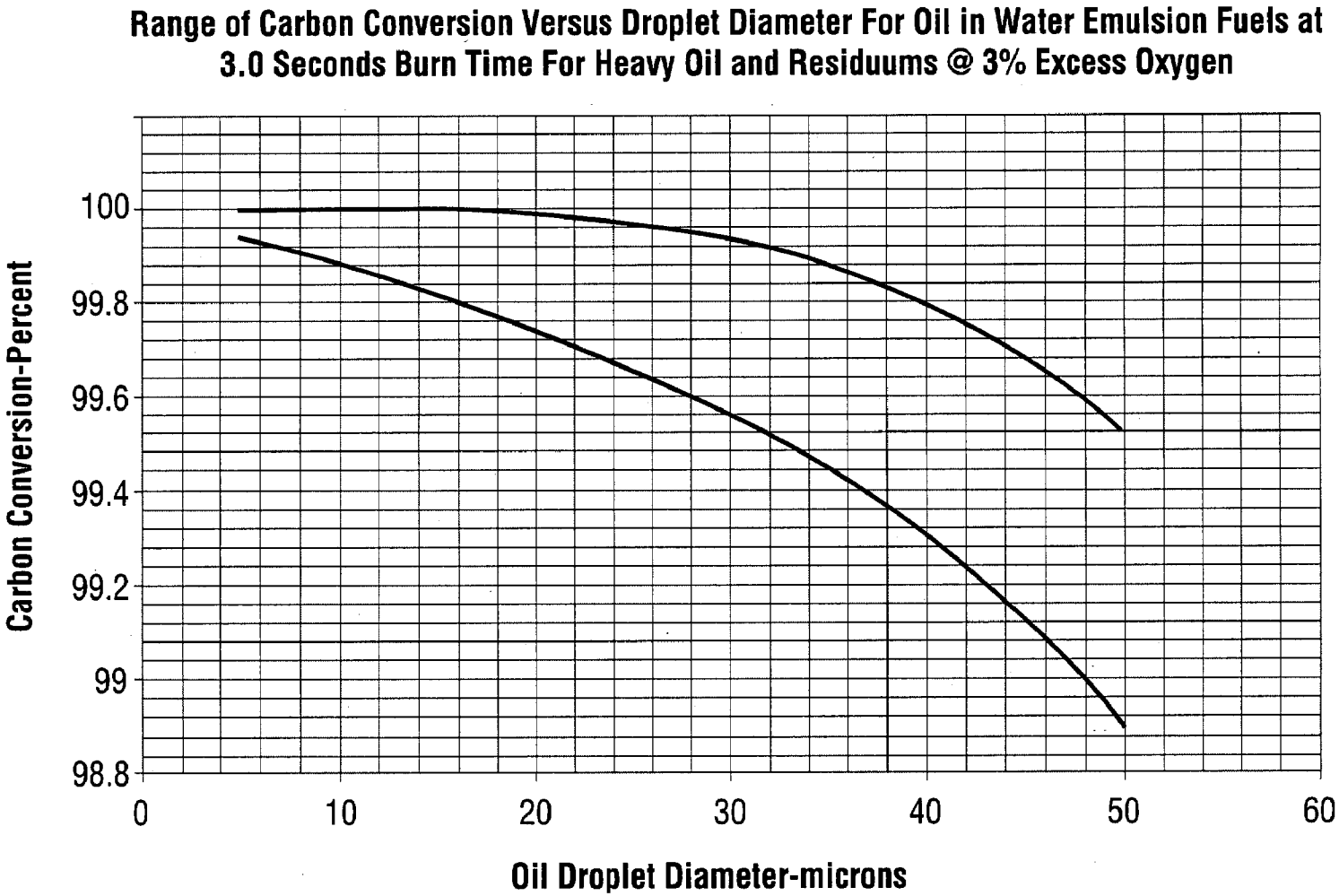
FIG. 2 is a graphical representation of carbon burnout as a function of droplet size.

FIG. 2 illustrates the effect of droplet size relation to carbon burnout. The present invention, by providing a droplet size in the range specified, maximizes on the relationship for the emulsified fuel.

Figure 3:
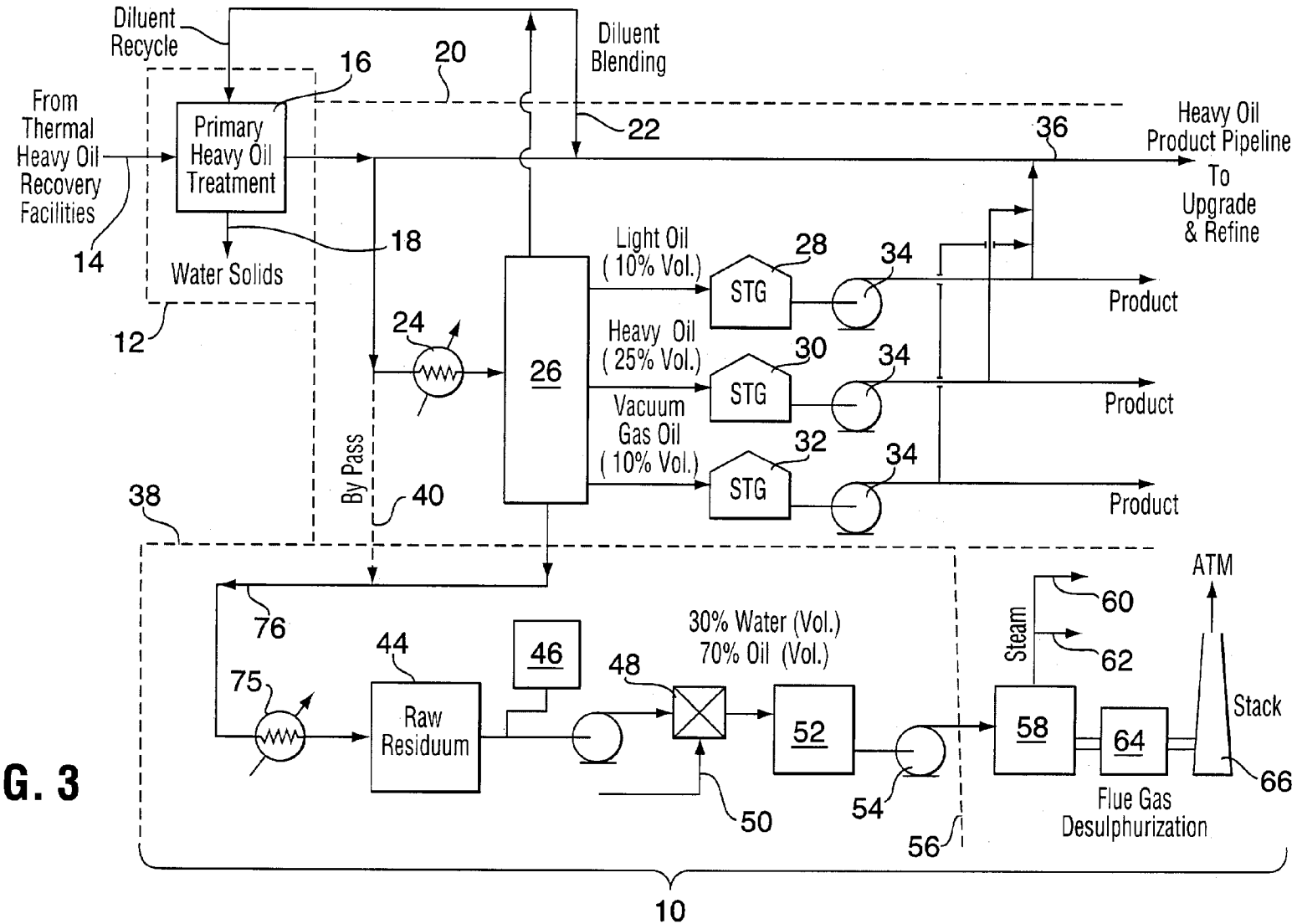
FIG. 3 is a schematic illustration of a process for converting heavy oil residuum into a fuel according to one embodiment of the invention using preheat for viscosity reduction.

FIG. 3 illustrates the preheating of residuum 76 by exchanger 75 to lower the viscosity to below 5000 centipoises and more particularly to below 500 centipoises for greater ease in pumping, handling and mixing with an aqueous emulsion. This also has effect in the production of a substantially narrow size distribution of between 0.5 and 50 microns.

Figure 4:
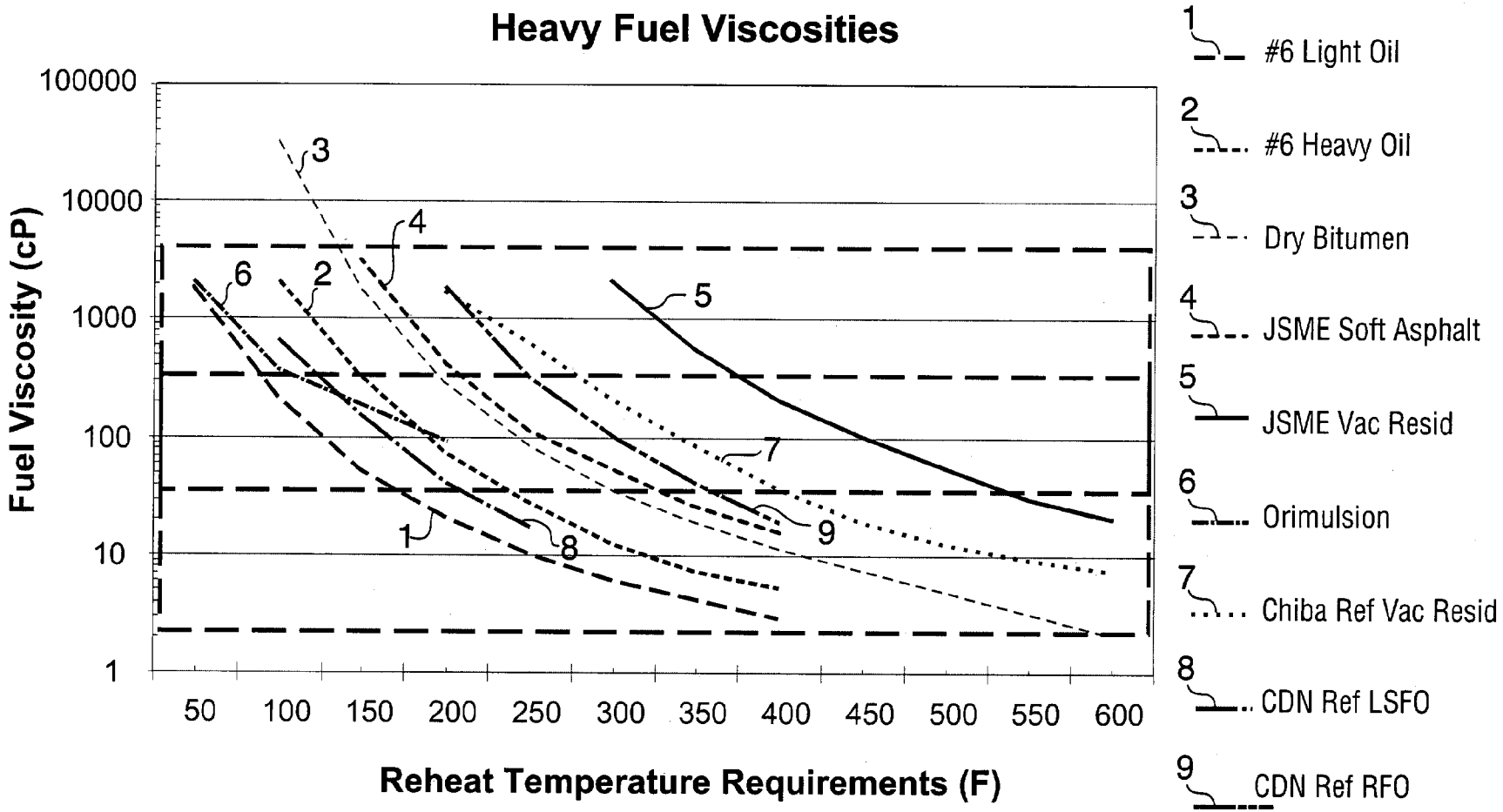
FIG. 4 is graphical representation of fluid viscosity as a function of reheat temperature requirements for a variety of heavy fuels.

For example, referring to FIG. 4 from the viscosity chart, the following preheat temperatures for the heavy fuels are desirable as feed to the mixer to formulate the micro-sized emulsion without diluent:

| Heavy Fuel Description | Fuel Preheat Requirements |
|---|---|
| #6 Light Fuel Oil | 35 to 65° C. |
| #6 Heavy Fuel Oil | 65 to 100° C. |
| Dry Bitumen Fuel | 95 to 125° C. |
| Soft Asphalt Residuum Fuel | 100 to 135° C. |
| Fractionated Residuum Fuel | 135 to 180° C. |
| Vacuum Residuum Fuel | 200 to 250° C. |
| Desaphalter Residuum Fuel | 250 to 350° C. |

The viscosity of the emulsified fuel is typically less than 100 Cp, ready for atomization in the burner.

Water temperature at 50 to the mixer 48 is controlled as required to regulate the emulsion temperature exiting the mixer to a suitable temperature for storage 52 and burning, for example, 65° C. to 95° C. would be desirable for atmospheric storage. Water preheating may be required for lighter fuel oils such as #6 fuel oils.

Figure 5:
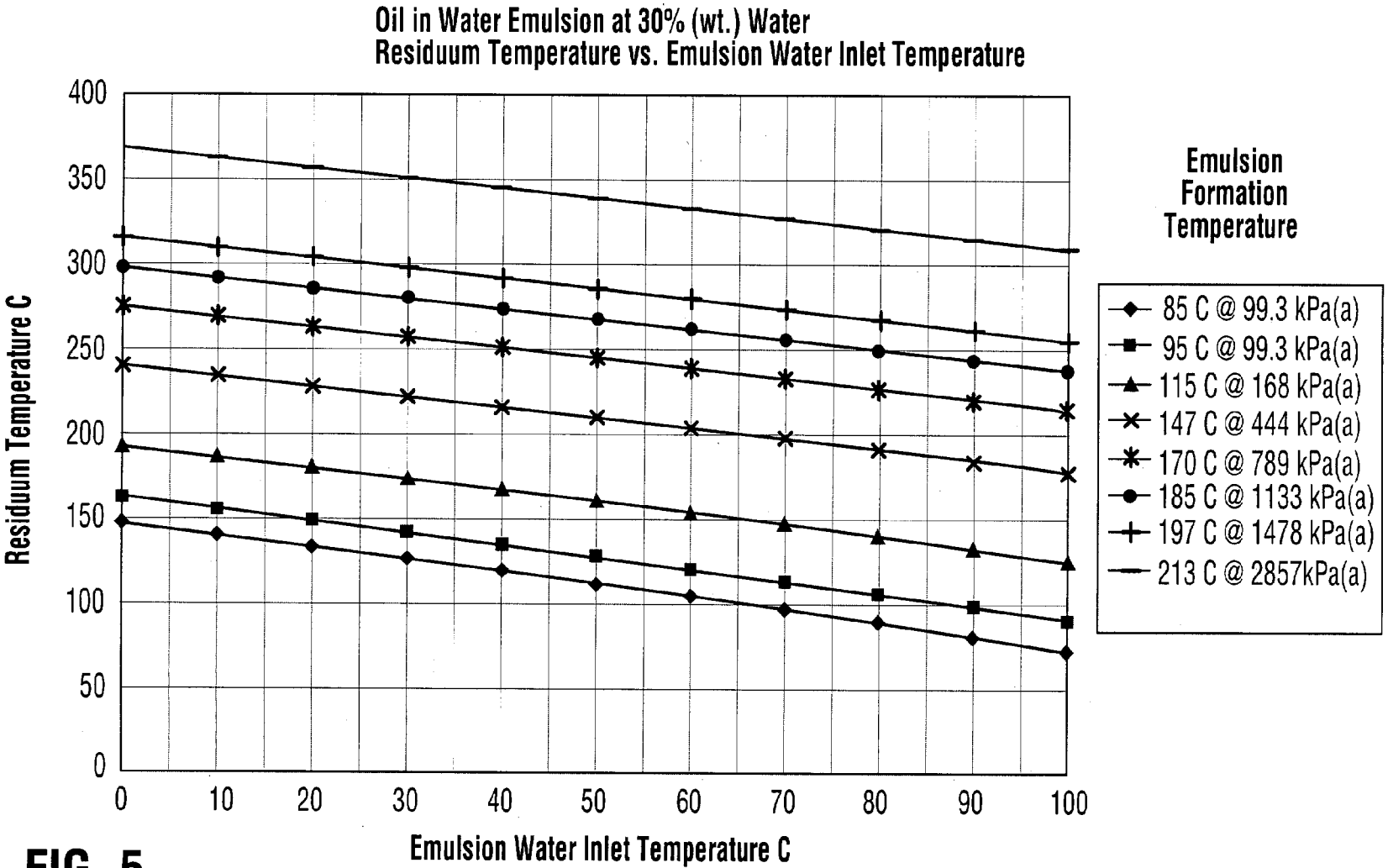
FIG. 5 is a graphical representation showing final emulsion fuel temperature and pressure for various preheat residuum fuel and feed water temperatures.

Further, the water temperature may also be regulated to produce a pressurized fuel for feed directly to the burners without the need for additional pumping indicated by numeral 54. FIG. 5 illustrates curves which show the temperature and pressure operating parameters resulting from the preheated residuum and feed water temperatures.

Figure 6:
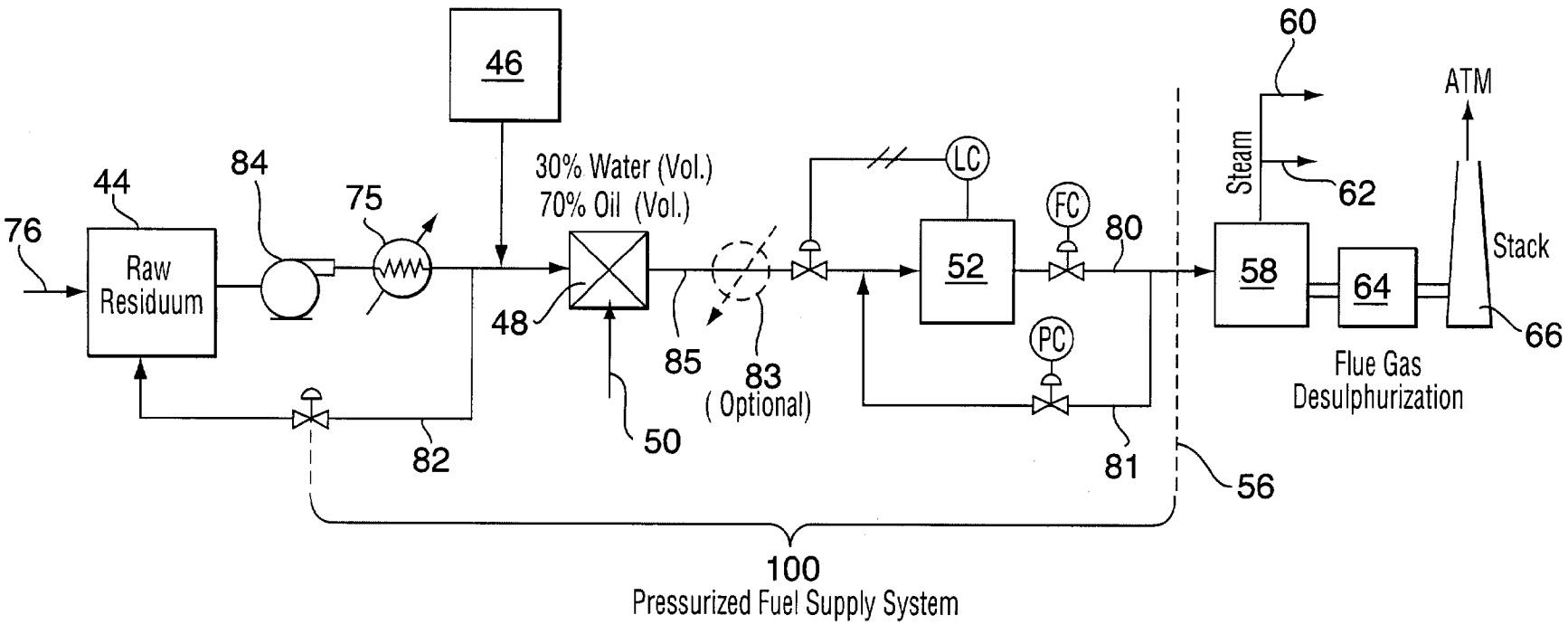
FIG. 6 is a schematic illustration of a pressurized process for converting heavy oil residuum into a fuel according to one embodiment of the invention.

FIG. 6 illustrates a further embodiment of the present invention where the system is pressurized to maintain the fuel emulsion. The residuum is pumped by pump 84 and preheated by exchanger 75 into emulsification preparation unit 48 where water 50 is added. The so-formed emulsion 85 may be optionally cooled at 83 and stored in vessel 52 or passed directly through to combustion device 58.

In view of the fact that the pressure is maintained from the pump 84 to the combustion device 58, the emulsion does not degrade or experience temperature increases which would otherwise degrade the emulsion. The pressure is maintained throughout the process from pump 84 to combustion device 58 as denoted by numeral 100.

A pressurized emulsion fuel is produced and fed immediately to the burner with pressurized fuel storage. In this embodiment, emulsion fuel pumps 54 are eliminated, which is very desirable as pumping of this fuel may have adverse effects on fuel stability and other fuel properties.

EXAMPLES

Example 1

Residuum Fuel from Atmospheric Distillation Unit (ADU)

ADU Residuum Fuel Inlet Temperature=180° C. at 75
Recommended Feed Water Inlet Temperature=20° C. to 100° C. at 50
Final Emulsion Fuel Temperature and Pressure Range=115° C. to 147° C. at 85

The emulsion fuel, after mixing is maintained at a pressure greater than 350 kPa(g) prior to atomization at the burner 58. Optional heat exchanger is not required.

Example 2

Residuum Fuel from Deasphalting Unit

Deasphalter Residuum Fuel Preheated=300° C. at 75
Recommended Feed Water Inlet Temperature=25° C. at 50
Final Emulsion Fuel Temperature and Pressure=197° C. at 1400 kPa(g) at 85

In this example, the emulsion is fed directly from the mixer to an optional heat exchanger 83 where the temperature is reduced to the range of 115° C. to 147° C. prior to atomization at the burner 58.

Figure 7:
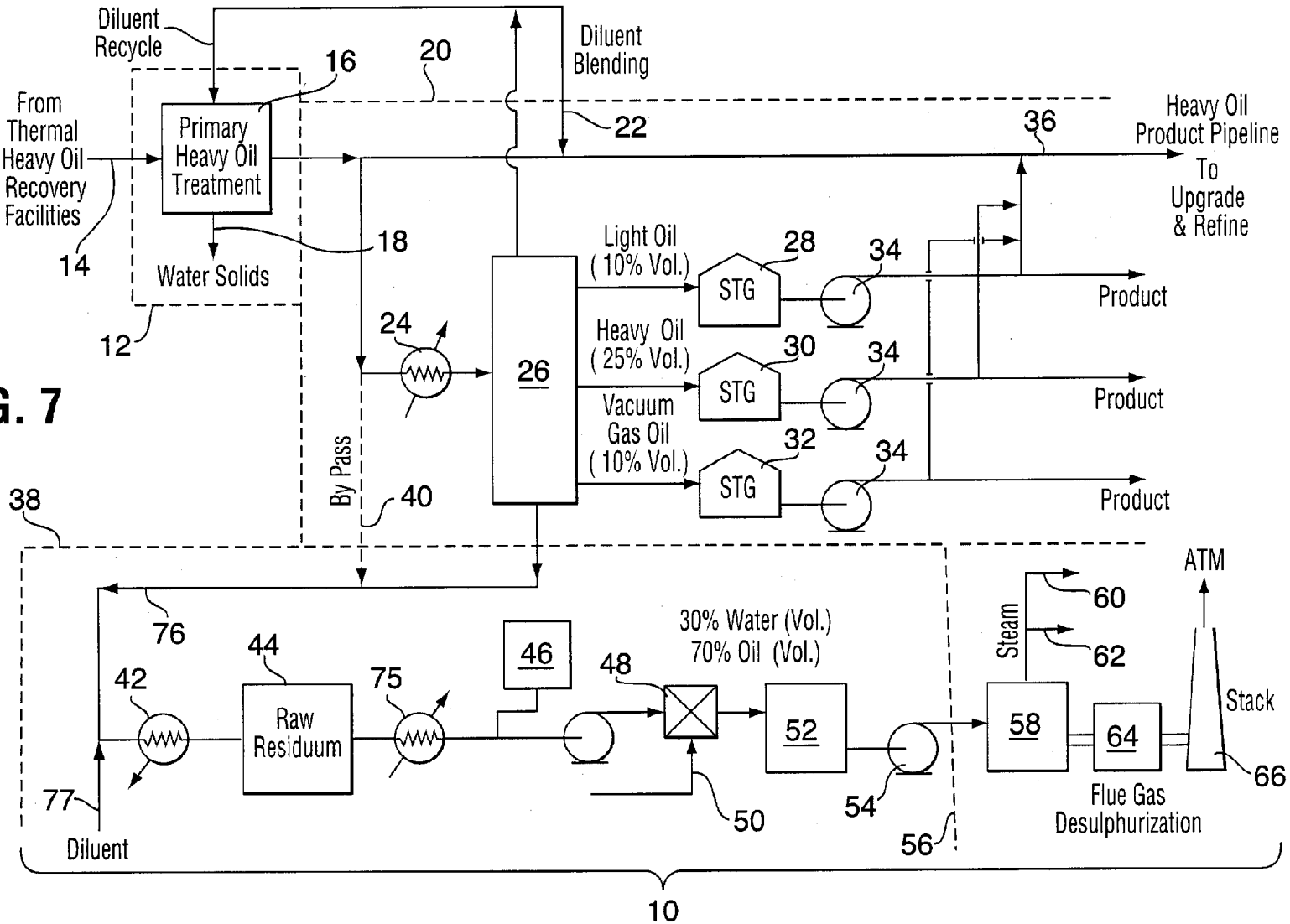
FIG. 7 is a schematic illustration of a process for converting heavy oil residuum into a fuel according to one embodiment of the invention using combined viscosity reduction by preheat and diluent addition.

Referring to FIG. 7, a further embodiment of this invention is to combine the methods of adding diluent and preheat to achieve the desired reduced viscosity for mixing to enable production of aqueous based emulsion fuels. As an example, heavy vacuum residuum 76, which can became un-pumpable at temperatures less than 150° C., can be premixed with a diluent at 77 immediately after the fractionation step to reduce the viscosity to less than 5000 Cp, more specifically less than 1000 Cp and cooled to temperatures less than 95° C. at 42 for storage at 44. The aqueous fuel can be preheated to the desired temperature on demand to facilitate viscosities less than 500 Cp, more specifically less than 200 Cp at 75 for the formation of the required micro-sized emulsion. This method is particularly desirous if the heavy residuum requires long term or seasonal storage at 44 prior to emulsion fuel preparation at 48. Further, this method permits the use of a waste stream as diluent 77 for disposition in the fuel. The addition of diluent 77 provides the specific minimum fuel properties required for storage and handling at 44, from where the diluent residuum fuel can then be preheated at 75 and mixed with water at 48 to form the fuel emulsion as required for immediate burning at 58 without storage. Any form of diluent, compatible with the burning properties of the emulsion fuel, can be used to achieve the desired viscosity requirements. The diluent may or may not contribute to the final heating value of the emulsion fuel as the fuel rate can be adjusted to maintain the desired heat content, however the diluent must not effect the performance of the emulsion fuel.

Both the formation and mixing stages 48 and the storage and handling stages 44 of the emulsion fuel may occur at atmospheric conditions or pressurized conditions as required by the properties of the original residuum fuel, diluent, and the final emulsion fuel. It is desirous, as known by those skilled in the art, that the emulsion must be at a sufficient pressure greater than the vapour pressure of the emulsion fuel to maintain a liquid fuel state until atomizing occurs at the burner 58.

Due to the high sulfur content of the material as stated herein previously, the combustion products may be passed into a flue gas desulfurization unit 64 prior to being passed through stack 66 to the atmosphere. This desulfurization can also be performed in the combustion chamber, for boilers such as fluid bed type or external for conventional and OTSG (once thru steam generator) type boilers.

Heavy oil residuum has been discussed in detail here, however, it will be apparent that any residuum may be processed by the process 38. Variations will be appreciated by those skilled in the art.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. A method for converting heavy oil liquid residuum to a combustible fuel, comprising the steps of:

a) providing a source of heavy oil liquid residuum having a viscosity such that said residuum is substantially non flowable;

b) applying pressure for the following steps;

c) reducing said viscosity of said residuum by preheating in a temperature range sufficient to facilitate flow without thermally degrading said residuum;

d) providing a mixing means;

e) providing water;

f) mixing said water and reduced viscosity residuum from the step of reducing said viscosity in said mixing means to form in said mixing means, an emulsion of predispersed residuum in an aqueous matrix in a size distribution suitable for use as a combustible fuel; and g) maintaining said emulsion under the applied pressure, absent pumping of said emulsion where said pressure is greater than the vapor pressure of said emulsion from steps c) through f) to prevent dehydration of said emulsion while maintaining stability of said emulsion.

2. The method as set forth in claim 1, wherein said size distribution is between 0.5 microns and 50 microns.

3. The method as set forth in claim 2, wherein said size distribution is between 5 microns and 50 microns.

4. The method as Bet forth in claim 1, wherein said predispersed residuum is in a liquid state.

5. The method as set forth in claim 1, wherein said predispersed residuum is in a solid state.

6. The method as set forth in claim 1, wherein said aqueous matrix and predispersed residuum therein comprises a substantially spherical particle.

7. The method as set forth in claim 6, wherein said aqueous matrix contains between 25% and 40% by weight water.

8. The method as set forth in claim 1, wherein said temperature range is between 35° C. and 350° C.

9. The method as set forth in claim 1, wherein said heavy oil liquid residuum is selected from the group consisting of light fuel oil, heavy fuel oil, dry and wet bitumen fuel, fractionated residuum fuel, soft asphalt residuum fuel, vacuum residuum fuel, deasphalter residuum fuel.

10. A method for converting heavy oil residuum to a combustible fuel, comprising the steps of:

a) providing a source of heavy oil liquid residuum having a viscosity such that said residuum is substantially non flowable;

b) progressively reducing said viscosity of said residuum in at least two stages to facilitate flow of said residuum, said stages comprising:

c) a first stage including treating said residuum with a liquid diluent to form a reduced viscosity residuum;

d) applying pressure for the following steps:

e) a second stage including preheating said reduced viscosity residuum;

f) providing a mixing means;

g) providing water;

h) mixing said water and reduced viscosity residuum from the step of reducing said viscosity in said mixing means to form in said mixing means, an emulsion of predispersed residuum in an aqueous matrix in a particle size distribution of between 0.5 microns and 50 microns suitable for use as a combustible fuel; and i) maintaining said emulsion under the applied pressure, absent pumping of said emulsion where said pressure is greater than the vapor pressure of said emulsion from steps c) through h) to prevent dehydration of said emulsion while maintaining stability of said emulsion.

11. The method as set forth in claim 10, wherein said temperature range is between 35° C. and 350° C.

12. The method as set forth in claim 10, wherein each said aqueous matrix comprises between 25% and 40% by weight water.

13. The method as set forth in claim 10, wherein said predispersed residuum is liquid.

14. The method as set forth in claim 10, wherein said predispersed residuum is solid.

15. The method as set forth in claim 10, wherein said aqueous matrix and predispersed fuel therein comprises a substantially spherical particle.

16. A process for converting heavy oil residuum to a combustible fuel, comprising the steps of:

a) providing a source of heavy oil;

b) pretreating said oil to remove at least a portion of entrained water;

c) treating said oil to form fractions, at least one of which is heavy oil residuum;

d) applying pressure for the following steps:

e) reducing said viscosity of said residuum by preheating in a temperature range sufficient to facilitate flow without thermally degrading said residuum;

f) providing a mixing means;

g) providing water;

h) mixing said water and reduced viscosity residuum from the step of reducing said viscosity in said mixing means;

i) forming, in said mixing means, an emulsion of predispersed residuum in an aqueous matrix in a size distribution suitable for use as a combustible fuel; and j) maintaining said emulsion under the applied pressure, absent pumping of said emulsion where said pressure is greater than the vapor pressure of said emulsion from steps e) through i) to prevent dehydration of said emulsion while maintaining stability of said emulsion.

17. The method as set forth in claim 16, wherein pressure is maintained by regulating the temperature of said source of water.

18. The method as set forth in claim 16, wherein said emulsion is a pressurized emulsion.

19. The method as set forth in claim 16, wherein said temperature is between 35° C. and 350° C.

20. The method as set forth in claim 16, wherein said aqueous matrix comprises between 25% and 40% by weight water.

21. The method as set forth in claim 16, wherein said predispersed residuum is a liquid.

22. The method as set forth in claim 16, wherein said predispersed residuum is a solid.

23. A method for converting heavy oil residuum to a combustible fuel, comprising the steps of:

a) providing a source of heavy oil;

b) pre-treating said oil to remove at least a portion of entrained water;

c) treating said oil to form fractions, at least one of which is heavy oil residuum;

d) progressively reducing said viscosity of said residuum in at least two stages to facilitate flow of said residuum, said stages comprising:

e) a first stage including treating said residuum with a liquid diluent to form a reduced viscosity residuum;

f) applying pressure for the following steps:

g) a second stage including preheating said reduced viscosity residuum in a temperature range of between 35° C. and 350° C.;

h) providing a mixing means;

i) providing water;

j) mixing said water and reduced viscosity residuum in said mixing means to form in said mixing means, an emulsion of predispersed residuum in an aqueous matrix in a size distribution suitable for use as a combustible fuel; and k) maintaining said emulsion under the applied pressure, absent pumping of said emulsion where said pressure is greater than the vapor pressure of said emulsion from steps eg) through j) to prevent dehydration of said emulsion while maintaining stability of said emulsion.

24. The method as set forth in claim 23, wherein said size distribution is between 0.5 microns and 50 microns.

25. The method as set forth in claim 24, wherein said size distribution is between 5 microns and 50 microns.

26. The method as set forth in claim 23, wherein said predispersed residuum is in a liquid state.

27. The method as set forth in claim 23, wherein said predispersed residuum is in a solid state.

28. A pressurized fuel for direct use burn, comprising an emulsion of predispersed residuum in water in a size distribution suitable for use as a combustible fuel under pressure sufficient to prevent dehydration of said emulsion and in a size distribution of between 0.5 and 50 μm.

29. A pressurized fuel for direct use bum made in accordance with the process of claim 1.

* * * * *